US006632134B2

(12) United States Patent
DePonio

(10) Patent No.: US 6,632,134 B2
(45) Date of Patent: Oct. 14, 2003

(54) BUILDING FIRE EXTINGUISHER SYSTEM

(76) Inventor: Wallace A. DePonio, 2700 Shimmons Rd., Lot 16, Auburn Hills, MI (US) 48326

( * ) Notice: Subject to any disclaimer, the term of this patent is extended or adjusted under 35 U.S.C. 154(b) by 0 days.

(21) Appl. No.: 10/039,693

(22) Filed: Jan. 3, 2002

(65) Prior Publication Data

US 2003/0124972 A1 Jul. 3, 2003

(51) Int. Cl.[7] ..... F24F 7/06
(52) U.S. Cl. ..... 454/342; 454/903
(58) Field of Search ..... 454/342, 343, 454/347, 903, 63, 65; 169/91

(56) References Cited

U.S. PATENT DOCUMENTS

| | | | | | |
|---|---|---|---|---|---|
| 667,149 | A | * | 1/1901 | Kenney | 169/91 |
| 1,926,298 | A | * | 9/1933 | Moore | 415/121.3 |
| 2,078,580 | A | * | 4/1937 | Moore | 417/234 |
| 2,120,563 | A | * | 6/1938 | Lamb | 5/18.1 |
| 2,348,455 | A | * | 5/1944 | Daudelin | 454/200 |
| 3,818,816 | A | * | 6/1974 | Petit | 454/342 |
| 3,926,101 | A | | 12/1975 | Moss | |
| 4,054,084 | A | | 10/1977 | Palmer | |
| 4,158,462 | A | * | 6/1979 | Coral | 285/144.1 |
| 4,311,198 | A | * | 1/1982 | Vasquez | 169/11 |
| 4,515,070 | A | * | 5/1985 | Bobjer et al. | 454/354 |
| 4,796,520 | A | * | 1/1989 | Kramer, Jr. | 454/367 |
| 5,468,184 | A | | 11/1995 | Collier | 454/186 |
| 5,855,510 | A | | 1/1999 | McKenzie | 454/342 |
| 5,957,212 | A | | 9/1999 | Sundholm | 169/54 |
| 5,990,789 | A | | 11/1999 | Berman et al. | 340/506 |
| 6,402,613 | B1 | * | 6/2002 | Teagle | 454/195 |

FOREIGN PATENT DOCUMENTS

| | | | | |
|---|---|---|---|---|
| CH | 354233 | * | 6/1961 | 454/903 |
| JP | 52-51744 | * | 4/1977 | 454/342 |

* cited by examiner

*Primary Examiner*—Harold Joyce

(57) ABSTRACT

A building fire extinguisher system for promptly removing smoke and flammable gases from a room upon detection of a fire. The building fire extinguisher system includes a vacuum unit, a housing having a door with a powered door latch, and an intake nozzle connected to the vacuum unit by a flexible tube. When smoke detectors detect the presence of a fire within a room, the powered door latch is opened thereby allowing the door to open. When the door is opened, the intake nozzle is dropped from the housing downwardly while the vacuum is activated. The intake end of the intake nozzle draws smoke and flammable gases from within the room into the flexible tube and out through an exhaust port externally of the building. The vacuum continues to operate until the presence of a fire is no longer detected or for a fixed period of time.

16 Claims, 6 Drawing Sheets

BUILDING FIRE EXTINGUISHER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to fire extinguishing devices and more specifically it relates to a building fire extinguisher system for promptly removing smoke and flammable gases from a room upon detection of a fire.

2. Description of the Prior Art

Fire extinguishing systems for buildings have been in use for years. Conventional fire extinguishing systems detect the presence of a fire and then apply water, foam or other fire extinguishing substance to one or more rooms containing the fire to extinguish the fire. The main problem with conventional building fire extinguisher systems is that after usage severe damage to objects and the room may occur. A further problem with conventional building fire extinguisher systems is that they require the cleaning up after usage of the extinguisher system. Another problem with conventional fire extinguisher systems is that they do not remove the smoke from the building which can cause significant damage to a building and death to individuals within the building.

Examples of patented devices which are related to the present invention include U.S. Pat. No. 5,855,510 to McKenzie; U.S. Pat. No. 3,926,101 to Moss; U.S. Pat. No. 5,990,789 to Berman et al.; U.S. Pat. No. 4,054,084 to Palmer; U.S. Pat. No. 5,957,212 to Sundholm; and U.S. Pat. No. 5,468,184 to Collier.

While these devices may be suitable for the particular purpose to which they address, they are not as suitable for promptly removing smoke and flammable gases from a room upon detection of a fire. Conventional fire extinguishing systems do not provide a convenient and clean means for removing smoke and flammable gases from a building.

In these respects, the building fire extinguisher system according to the present invention substantially departs from the conventional concepts and designs of the prior art, and in so doing provides an apparatus primarily developed for the purpose of promptly removing smoke and flammable gases from a room upon detection of a fire.

SUMMARY OF THE INVENTION

In view of the foregoing disadvantages inherent in the known types of fire protection systems now present in the prior art, the present invention provides a new building fire extinguisher system construction wherein the same can be utilized for promptly removing smoke and flammable gases from a room upon detection of a fire.

The general purpose of the present invention, which will be described subsequently in greater detail, is to provide a new building fire extinguisher system that has many of the advantages of the fire extinguishing systems mentioned heretofore and many novel features that result in a new building fire extinguisher system which is not anticipated, rendered obvious, suggested, or even implied by any of the prior art fire extinguishers, either alone or in any combination thereof.

To attain this, the present invention generally comprises a vacuum unit, a housing having a door with a powered door latch, and an intake nozzle connected to the vacuum unit by a flexible tube. When smoke detectors detect the presence of a fire within a room, the powered door latch is opened thereby allowing the door to open. When the door is opened, the intake nozzle is dropped from the housing downwardly while the vacuum is activated. The intake end of the intake nozzle draws smoke and flammable gases from within the room into the flexible tube and out through an exhaust port externally of the building. The vacuum continues to operate until the presence of a fire is no longer detected or for a fixed period of time.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a building fire extinguisher system that will overcome the shortcomings of the prior art devices.

A second object is to provide a building fire extinguisher system for promptly removing smoke and flammable gases from a room upon detection of a fire.

Another object is to provide a building fire extinguisher system that reduces smoke damage to a building having a fire.

An additional object is to provide a building fire extinguisher system that potentially increases the survival of people in the building by clearing out smoke from the building.

A further object is to provide a building fire extinguisher system that reduces damage to objects within a room by not utilizing water or harmful chemicals.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 3:
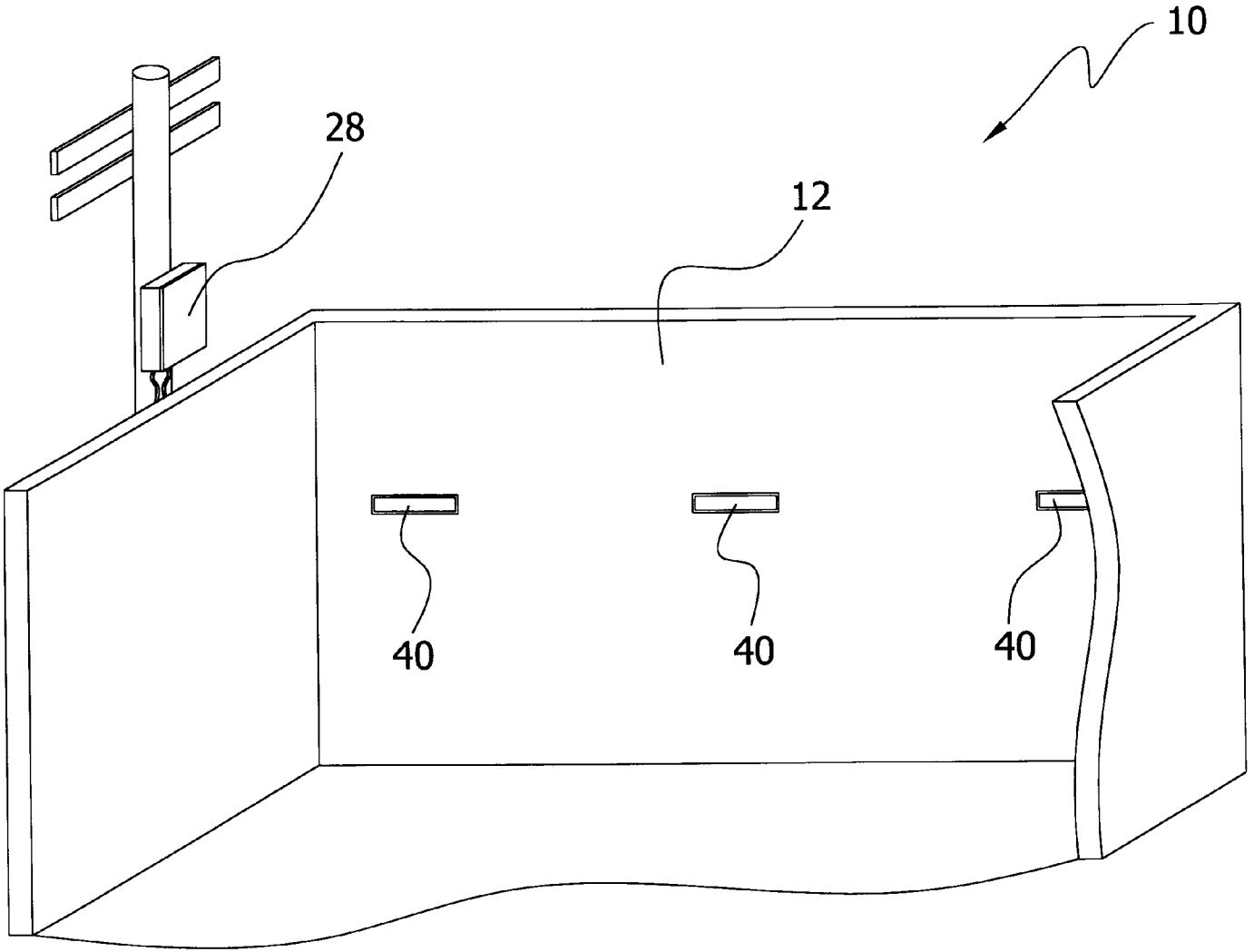
FIG. 3 is an upper perspective view of a room containing the present invention.

Turning now descriptively to the drawings, in which similar reference characters denote similar elements throughout the several views, FIGS. 1 through 6 illustrate a building fire extinguisher system 10, which comprises a vacuum unit 20, a housing 30 having a door 40 with a powered latch, and an intake nozzle 60 connected to the vacuum unit 20 by a flexible tube 64. When smoke detectors detect the presence of a fire within a room, the powered latch is opened thereby allowing the door 40 to open. When the door 40 is opened, the intake nozzle 60 is dropped from the housing downwardly while the vacuum is activated. The intake end of the intake nozzle 60 draws smoke and flammable gases from within the room into the flexible tube 64 and out through an exhaust port externally of the building. The vacuum continues to operate until the presence of a fire is no longer detected or for a fixed period of time. One or more units of the present invention may be positioned within a room as shown in FIG. 3 of the drawings.

Figure 1:
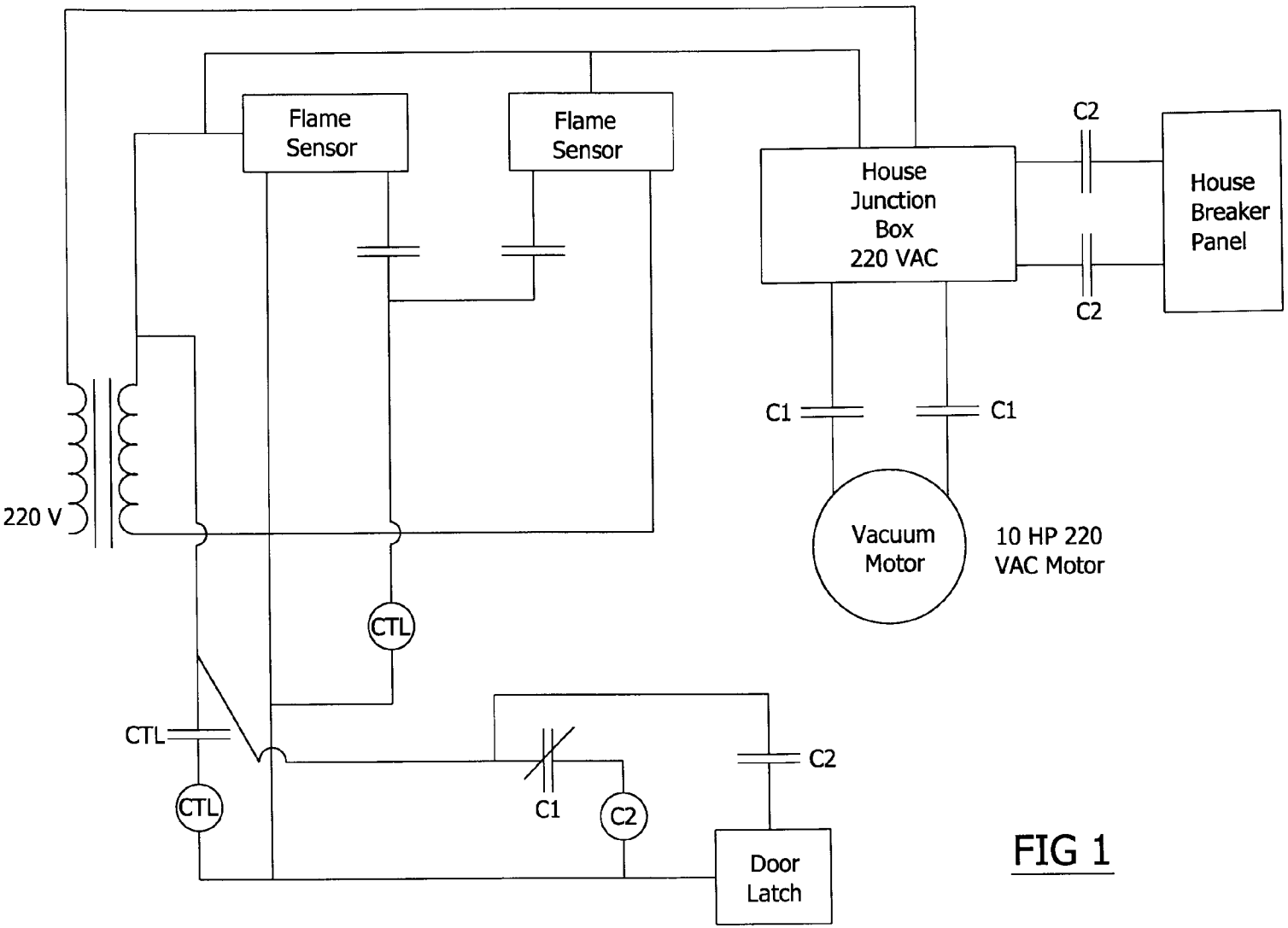
FIG. 1 is a schematic diagram of the present invention.
Figure 2:
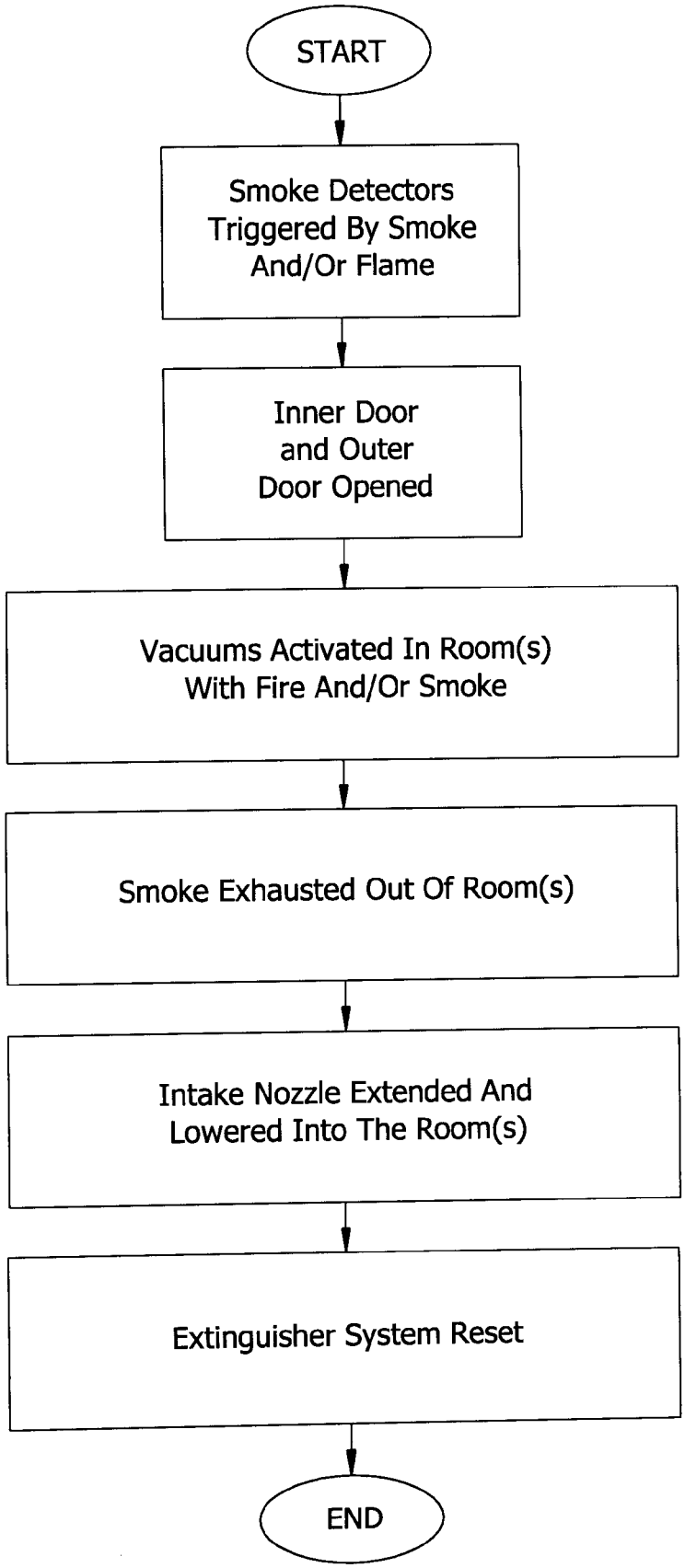
FIG. 2 is a flowchart illustrate the operation of the present invention.

FIG. 1 is a schematic diagram of the present invention. As illustrated in FIG. 1, a plurality of fire sensors positioned within a room are electrically connected to the control unit 28 to indicate when a fire is present within a particularly room. The fire sensors may be comprised of various types of fire detecting sensors such as but not limited to heat sensors or smoke detectors. The fire sensors may be positioned anywhere through the room as desired.

Figure 4:
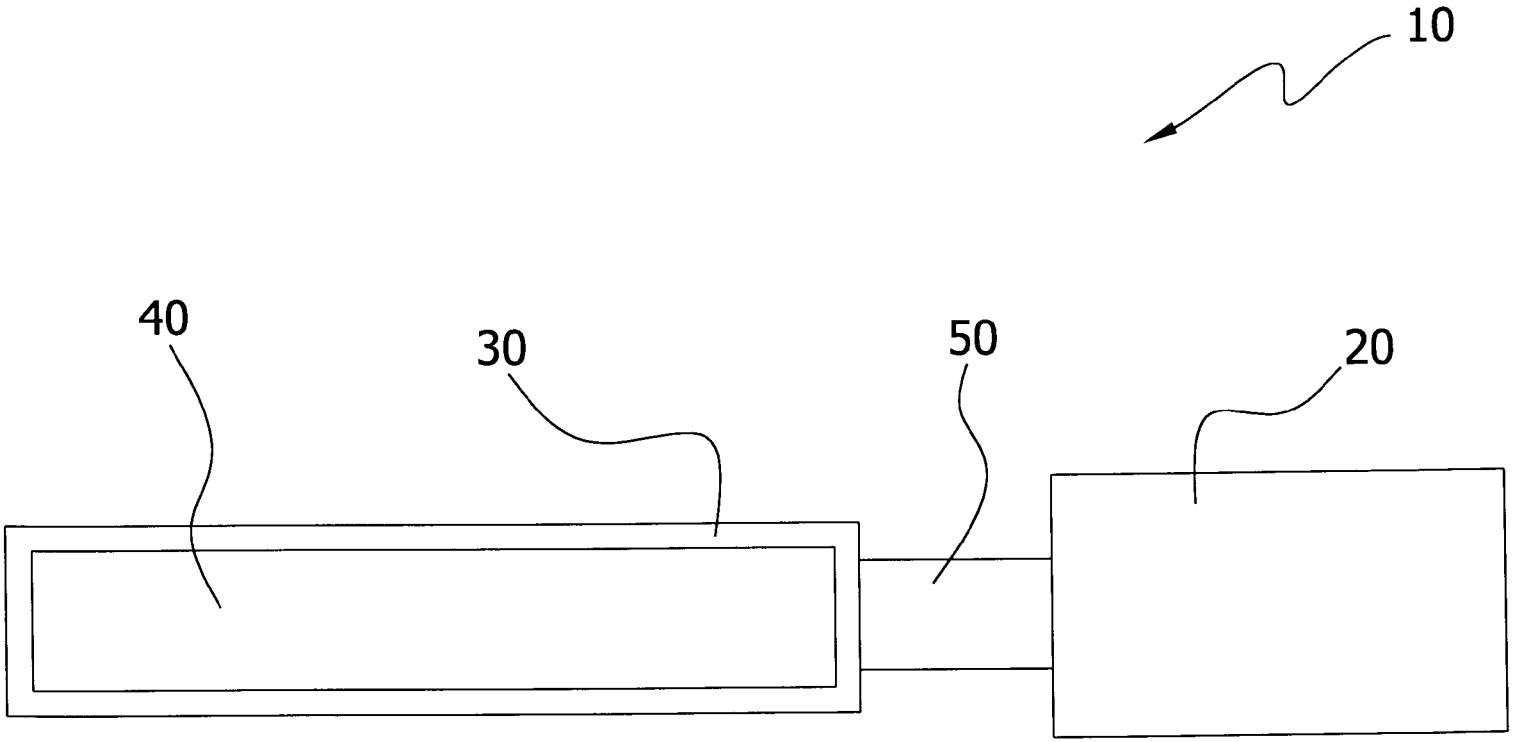
FIG. 4 is a side view of the present invention with the door closed.
Figure 5:
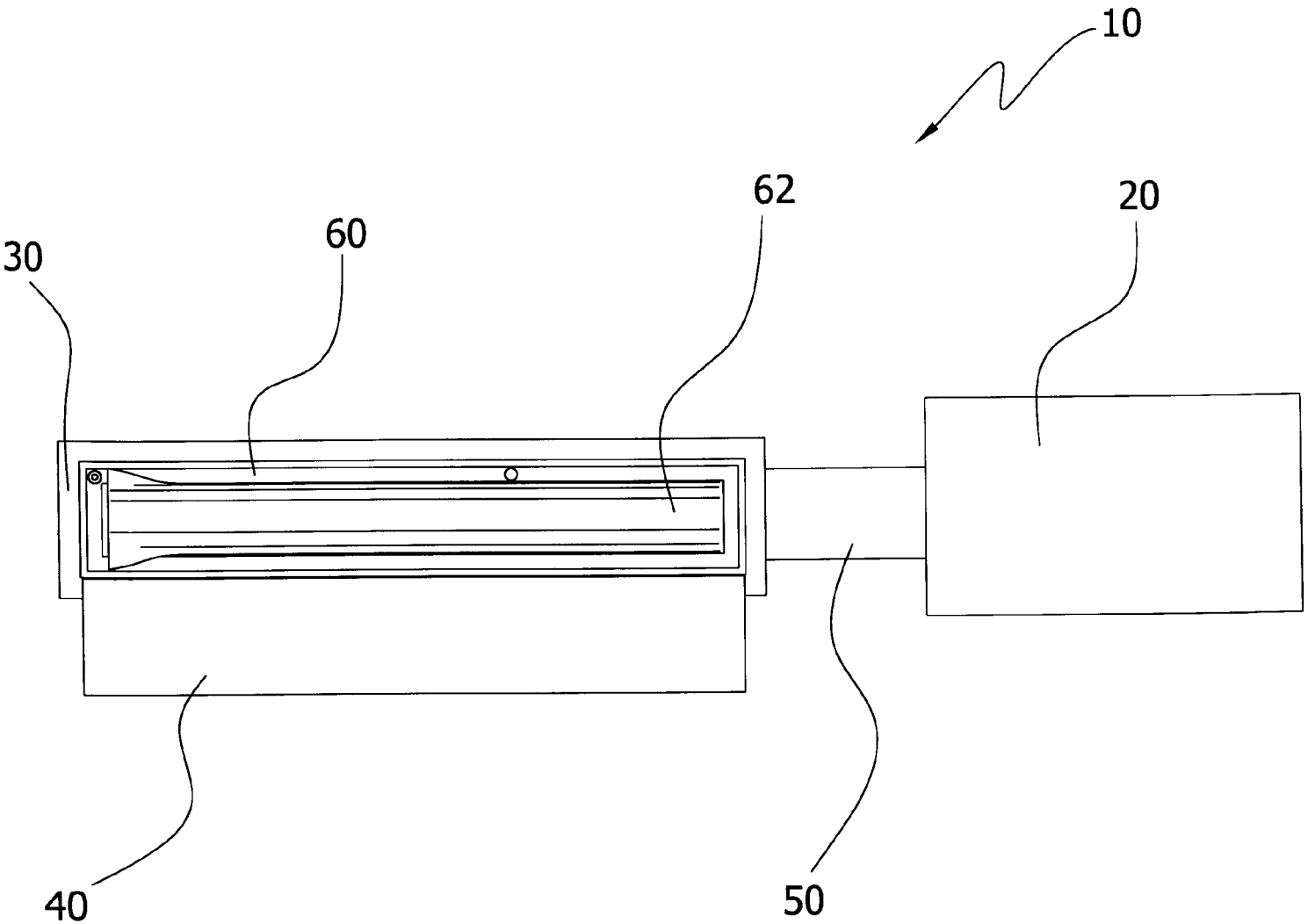
FIG. 5 is a side view of the present invention with door opened for releasing the intake nozzle.
Figure 6:
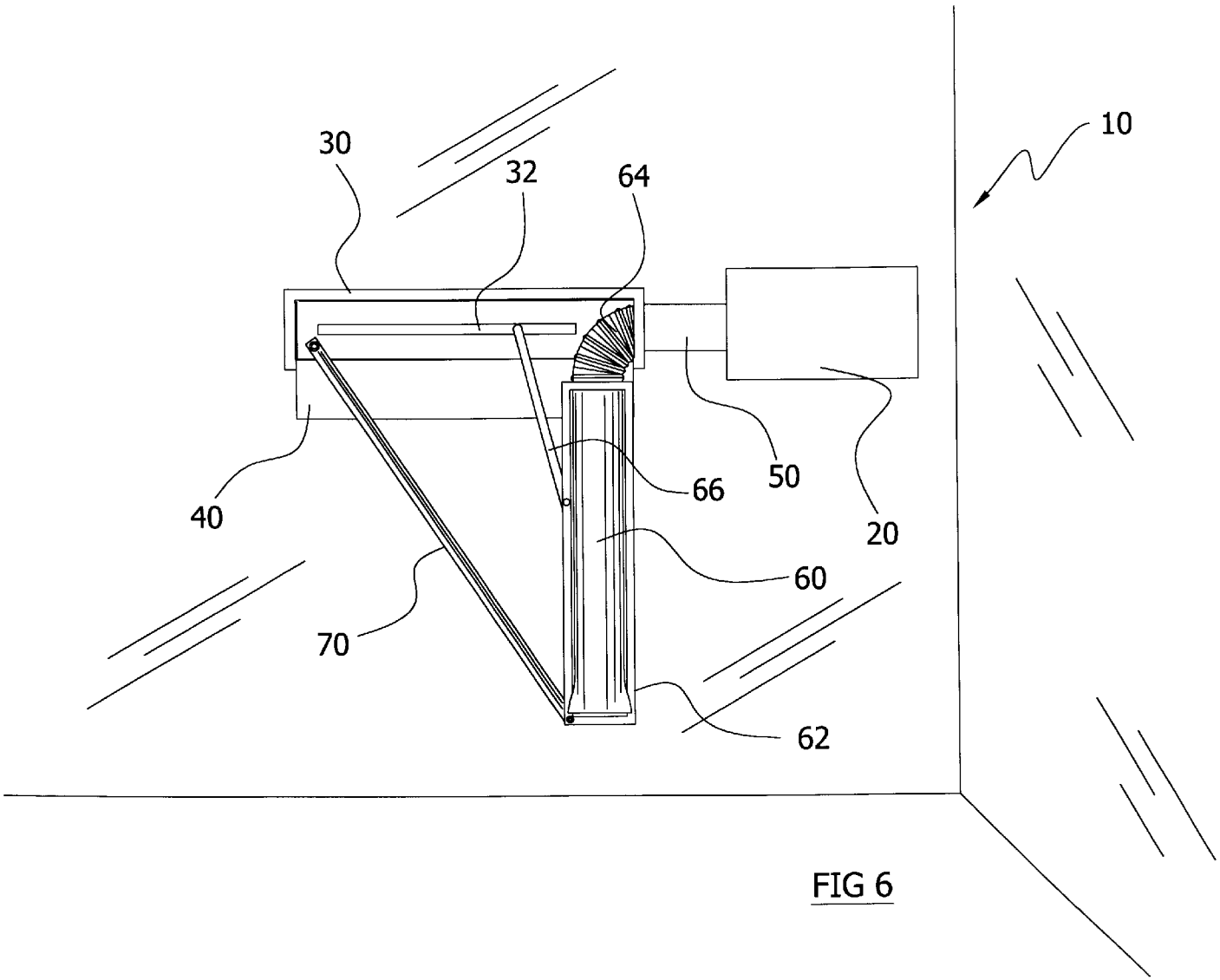
FIG. 6 is a side view of the present invention with the intake nozzle lowered into the room.

As shown in FIGS. 4 through 6 of the drawings, a housing 30 is provided that is attached within a wall 12. The housing 30 may be positioned upon the surface of the wall 12 or within the wall 12. The housing 30 is preferably comprised of a heat resistant material such as but not limited to ceramic. The housing 30 may have various shapes and structures that are suitable for receiving and storing the intake nozzle 60. The housing 30 has a side opening for releasing the intake nozzle 60 from within as shown in FIGS. 5 and 6 of the drawings.

A door 40 is pivotally attached to a lower portion of the housing 30 to selectively cover the side opening within the housing 30. The door 40 is retained in a closed position within the housing 30 by an electrically powered latch. The electrically powered latch is in communication with the control unit 28, wherein the control unit 28 controls the opening and closing of the powered latch depending upon the detection of a fire within the room. If a fire is detected within the room, the control unit 28 opens the powered latch to allow the door 40 within the housing 30 to be opened thereby allowing the intake nozzle 60 to exit the housing 30.

A vacuum unit 20 is positioned adjacent to the housing 30 and is connected to the housing 30 via a connecting tube 50. The vacuum unit 20 is fluidly connected to an exhaust port external of the building to allow for the escape of smoke and gases. The vacuum unit 20 is comprised of a structure capable of drawing heated gases from a building. The vacuum unit 20 is in communication with the control unit 28 and is activated when. the fire sensors detect the presence of a fire.

A flexible tube 64 is fluidly connected to the vacuum as shown in FIG. 6 of the drawings. The intake nozzle 60 is fluidly connected to the flexible tube 64 opposite of the vacuum unit 20. An outer frame 62 preferably surrounds the intake nozzle 60 as shown in FIG. 6 of the drawings. The intake nozzle 60 is comprised of an elongate rigid structure that is comprised of a heat resistant material. The intake nozzle 60 includes an intake port that is preferably broadened at the end as shown in FIGS. 5 and 6 of the drawings. When the intake nozzle 60 is fully extended downwardly, the intake port is a finite distance from the surface of the floor as desired.

An elongate spring 70 is attached within the interior portion of the housing 30 as best shown in FIG. 6 of the drawings. The elongate spring 70 is preferably comprised of a structure that is capable of being compacted when the intake nozzle 60 is positioned within the housing 30 and that applies an outward force upon the intake nozzle 60 when the door 40 is opened. The length of the elongate spring 70 limits the movement of the distal portion of the intake nozzle 60 as shown in FIG. 6 of the drawings. The elongate spring 70 may be comprised of various structures, however, the elongate spring 70 is preferably comprised of a metal ribbon material having a curved cross sectional shape similar to that utilized within tape measures and similar devices.

An arm member 66 is pivotally attached to an inner end of the intake nozzle 60 as shown in FIG. 6 of the drawings. The distal end of the arm member 66 is slidably positioned within a guide channel 32 within the housing 30 as shown in FIG. 6 of the drawings. As the intake nozzle 60 is removed from the housing 30, the arm member 66 slides along the guide channel 32 until the intake nozzle 60 is substantially vertically orientated as shown in FIG. 6 of the drawings.

In use, the fire sensors detect a fire within a particular room. The fire sensors communicate with the control unit 28 indicating that a fire is present within the particular room. The control unit 28 opens the powered latch thereby allowing the door 40 to open from the housing 30. The control unit 28 also activates power to the vacuum thereby drawing air from the intake nozzle 60 outside of the building. The intake nozzle 60 is allowed to fall. downwardly from the housing 30 with assistance provided by the elongate spring 70. The intake nozzle 60 falls from the housing 30 with the flexible tube 64 bending accordingly to accommodate the position of the intake nozzle 60. The arm member 66 slides within the guide channel 32 within the rear wall 12 of the housing 30 to assist in guiding the intake nozzle 60. When the elongate spring 70 is fully extended, the intake port of the intake nozzle 60 is pointed downwardly toward the floor with the intake nozzle 60 in a substantially vertical position. Smoke and flammable gases are drawn into the intake port of the intake nozzle 60 and dispersed external of the building through the vacuum unit 20. The vacuum unit 20 continues to operate for a predefined period of time-or until the fire sensors no longer detect the presence of a fire within the room.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the aft, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A building fire extinguisher system for removing smoke and gases from a room, comprising:

a control unit;

at least one fire sensor positioned within said room and in communication with said control unit;

a vacuum unit in communication with said control unit for activating said vacuum unit when a fire is detected, wherein an exhaust portion of the vacuum unit is fluidly connected externally of a building structure containing said room;

a housing having a side opening;

a door pivotally attached to said housing for selectively closing said housing;

a powered latch positioned with said housing and selectively engaging said door, wherein said powered latch is in communication with said control unit for opening said door when a fire is detected;

an intake nozzle fluidly connected to said vacuum unit; and an arm member pivotally attached to an inner end of said intake nozzle and slidably positioned within a guide channel within a rear wall of said housing.

2. The building fire extinguisher system of claim 1, wherein an intake port of said intake nozzle has a broad structure.

3. The building fire extinguisher system of claim 1, wherein said intake nozzle is fluidly connected to said vacuum unit by a length of flexible tube.

4. The building fire extinguisher system of claim 1, including a length of elongate spring attached within said housing and to an outer end of said intake nozzle.

5. The building fire extinguisher system of claim 4, wherein said elongate spring is comprised of a metal ribbon structure.

6. The building fire extinguisher system of claim 1, including a length of elongate spring attached within said housing and to an outer end of said intake nozzle.

7. The building fire extinguisher system of claim 6, wherein said elongate spring is comprised of a metal ribbon structure.

8. The building fire extinguisher system of claim 7, wherein said intake nozzle is comprised of an elongate tubular structure.

9. A building fire extinguisher system for removing smoke and gases from a room, comprising:

a control unit positioned externally of a building structure containing said room;

at least one fire sensor positioned within said room and in communication with said control unit;

a vacuum unit in communication with said control unit to activate said vacuum unit when a fire is detected, wherein an exhaust portion of the vacuum unit is fluidly connected externally of said building structure;

a housing having a side opening, wherein said housing is comprised of a heat resistant material;

a door pivotally attached to a lower edge of said housing for selectively closing said housing;

a powered latch positioned within said housing and selectively engaging said door, wherein said powered latch is in communication with said control unit to open said door when a fire is detected;

an intake nozzle fluidly connected to said vacuum unit; and an arm member pivotally attached to an inner end of said intake nozzle and slidably positioned within a guide channel within a rear wall of said housing.

10. The building fire extinguisher system of claim 9, wherein an intake port of said intake nozzle has a broad structure.

11. The building fire extinguisher system of claim 9, wherein said intake nozzle is fluidly connected to said vacuum unit by a length of flexible tube.

12. The building fire extinguisher system of claim 9, including a length of elongate spring attached within said housing and to an outer end of said intake nozzle.

13. The building fire extinguisher system of claim 12, wherein said elongate spring is comprised of a metal ribbon structure.

14. The building fire extinguisher system of claim 9, including a length of elongate spring attached within said housing and to an outer end of said intake nozzle.

15. The building fire extinguisher system of claim 14, wherein said elongate spring is comprised of a metal ribbon structure.

16. A method of removing smoke and gases from a room containing a fire utilizing a building fire extinguisher system comprising a control unit, at least one fire sensor positioned within said room and in communication with said control unit, a vacuum unit in communication with said control unit for activating said vacuum unit when a fire is detected, wherein an exhaust portion of the vacuum unit is fluidly connected externally of a building structure containing said room, a housing having a side opening, a door pivotally attached to said housing for selectively closing said housing, a powered latch positioned with said housing and selectively engaging said door, wherein said powered latch is in communication with said control unit for opening said door when a fire is detected, an intake nozzle fluidly connected to said vacuum unit, and an arm member pivotally attached to an inner end of said intake nozzle and slidably positioned within a guide channel within a rear wall of said housing, said method comprising the steps of:

(a) detecting a fire within a room;

(b) lowering said intake nozzle into said room;

(c) activating said vacuum unit fluidly connected to said intake nozzle for drawing smoke and gases from said room; and (d) deactivating said vacuum unit after a finite period of time of no detection of fire within room.

* * * * *